US005907739A

United States Patent [19]

Tsunemi et al.

[11] Patent Number: 5,907,739

[45] Date of Patent: May 25, 1999

[54] IMAGE FORMING APPARATUS

[75] Inventors: Takeo Tsunemi, Susono; Tsuyoshi Kunishi, Moriya-machi; Mitsuka Abe, Yokohama, all of Japan

[73] Assignee: Canon Kabushiki Kaisha, Tokyo, Japan

[21] Appl. No.: 08/807,749

[22] Filed: Feb. 27, 1997

[30] Foreign Application Priority Data

Mar. 5, 1996 [JP] Japan ..... 8-078388

[51] Int. Cl.[6] ..... G03G 15/00

[52] U.S. Cl. ..... 399/26; 399/24

[58] Field of Search ..... 399/24–26, 31

[56] References Cited

U.S. PATENT DOCUMENTS

| | | | |
|---|---|---|---|
| 4,707,748 | 11/1987 | Ohtsuka et al. | 358/298 |
| 4,961,088 | 10/1990 | Gilliland et al. | 399/25 |
| 5,008,711 | 4/1991 | Sakamoto et al. | 399/24 |
| 5,101,233 | 3/1992 | Ito et al. | 399/24 |
| 5,115,275 | 5/1992 | Suzuki | 399/24 |
| 5,159,388 | 10/1992 | Yoshiyama et al. | 399/26 |
| 5,160,967 | 11/1992 | Tonegawa | 399/26 |
| 5,278,612 | 1/1994 | Inui | 399/26 |
| 5,572,292 | 11/1996 | Chatani et al. | 399/25 |
| 5,726,759 | 3/1998 | Watanabe et al. | 399/26 X |

FOREIGN PATENT DOCUMENTS

| | | |
|---|---|---|
| 63-149669 | 6/1988 | Japan . |
| 4-001787 | 1/1992 | Japan . |
| 4-057068 | 2/1992 | Japan . |
| 5-223513 | 8/1993 | Japan . |
| 6-266270 | 9/1994 | Japan . |
| 7-175374 | 7/1995 | Japan . |
| 8-194408 | 7/1996 | Japan . |
| 8-220935 | 8/1996 | Japan . |

*Primary Examiner*—Matthew S. Smith

*Attorney, Agent, or Firm*—Fitzpatrick, Cella, Harper & Scinto

[57] ABSTRACT

An image forming apparatus has an image bearing member, a charging member which contacts with the image bearing member to charge it, detecting device for detecting an electric current flowing through the charging member when a predetermined voltage is applied thereto, and a display device for displaying an information about a life of the image bearing member in conformity with the result of detection by the detecting device. The display device can display at least two different kinds of information corresponding to at least two different electric currents detected by the detecting device.

17 Claims, 6 Drawing Sheets

IMAGE FORMING APPARATUS

BACKGROUND OF THE INVENTION

1. Field of the Invention

This invention relates to an image forming apparatus such as a transfer type electrophotographic apparatus or a transfer type electrostatic recording apparatus in which an image forming process is applied to an image bearing member such as an electrophotographic photosensitive member or an electrostatic recording dielectric member to thereby execute image formation and the image bearing member is repetitively used for image formation.

2. Related Background Art

A description will hereinafter be made of a transfer type electrophotographic apparatus (a copying apparatus, a printer or the like) as an example.

The transfer type electrophotographic apparatus generally uses as an image bearing member a rotatable drum type electrophotographic photosensitive member (a photosensitive drum) provided with a photosensitive layer as an image making layer on the outer peripheral surface of an electrically conductive drum base body, and applies known suitable image forming processes such as charging, image exposure and development thereto to thereby form a toner image corresponding to desired image information. The toner image is transferred to a transfer sheet as a recording medium by transfer means, and the transfer sheet to which the toner image has been transferred is separated from the surface of the photosensitive drum, and the toner image is fixated as a permanently secured image by fixating means, and the transfer sheet is discharged as an image forming article. Also, after the separation of the transfer sheet, the surface of the photosensitive drum has any residual contaminant such as untransferred toner (residual toner) thereon removed by cleaning means and is thus cleaned for repetitive use for image formation.

Also in such an image forming apparatus, an apparatus construction of the process cartridge mounting and dismounting type is widely used for a compact copying apparatus, a printer or the like in order to facilitate the maintenance of the apparatus. This is an apparatus construction in which process instruments such as a photosensitive drum as an image bearing member, a charging member for uniformly charging the photosensitive drum, developing means and cleaning means are made into a process cartridge contained as an unit and collectively removably mountable with respect to a main body of the image forming apparatus, and when the instruments therein reach their life, the entire process cartridge is replaced with a new one.

The photosensitive drum has a predetermined life and in some cases, it is interchanged by a serviceman judging the life from the integrated print sheet number value of a print sheet number counter provided on the apparatus body, but many photosensitive drums are set so as to be interchangeable by a user to enhance the convenience to the user. In this case, there is means for counting the number of rotations of the photosensitive drum to inform the user of the interchange time for the cartridge. As shown in Japanese Laid-Open Patent Application No. 6-266270, there is disclosed a method of detecting the quantity of waste toner in the waste toner container of a cleaning device to thereby cause that quantity to be displayed on the apparatus body.

1) However, for example, when the life of the photosensitive drum is reached and the process cartridge has reached the end of its life, if all of image forming operations are stopped to prevent a bad image or the overflow of waste toner, fax reception particularly at night or during absence becomes impossible in the case of an image forming apparatus having the fax function. As a countermeasure for it, there is usually adopted a method of providing a memory and temporarily accumulating received data therein, but the amount of data accumulated in the memory is limited and any amount exceeding the limit cannot be received. Also, if the memory is increased, this problem will be somewhat improved, but the cost of the apparatus will increase.

2) In the case of an image forming apparatus having the printing function of printing computer output data, if display is effected only on the image forming apparatus side even when the life of the process cartridge is nearly over, the user of the computer will be late in becoming aware of it.

There have also been the following problems.

3) Even when the life of the photosensitive drum is over and the process cartridge has reached its life and the acceleration of the interchange of the process cartridge is displayed, a new process cartridge is often not prepared beforehand, and therefore in some cases, a process cartridge having reached the end of its life had to be intactly used even if a bad image such as an injury or fog had occurred, or the use of the image forming apparatus had to be stopped.

4) The photosensitive layer of the image bearing member is gradually scraped by the image forming operation being repeated. The life of the process cartridge, i.e., the life of the image bearing member, is prescribed by the remaining film thickness of the photosensitive layer.

As a method of detecting the life of the process cartridge, there is also known a method of judging it from the number of outputted image sheets, but the remaining film thickness of the photosensitive layer by which the life of the image bearing member is prescribed differs depending on the size of the outputted sheets, or the condition as to whether the sheets have been outputted one by one or have been continuously outputted and therefore, there arises the problem that a bad image occurs before output is done from life detecting means or conversely, output is done from the life detecting means before a bad image occurs.

5) If the user continues to use the image forming apparatus in spite of the process cartridge having reached the end of its life and display for the acceleration of the interchange of the process cartridge being done, the waste toner container of the cleaning means becomes full of waste toner, which overflows from the cleaning means and contaminates the interior of the apparatus and further stains the printing sheet.

6) Even if it becomes known on the basis of the output from means for detecting the film thickness of the photosensitive layer of the image bearing member that the life of the process cartridge is nearly over or has been reached, if much time is required before a new process card is obtained when there is not prepared a new process cartridge beforehand or if the time from after the display of the life till the occurrence of a bad image is short, there will arise a problem similar to that noted under item 4) or 5) above.

7) If a developing bias or a transfer bias is applied during the detection of the film thickness of the image bearing member, the electric current thereof will flow into the film thickness detecting means, and therefore the detection error will become great.

The problems as noted above are matters not restricted to image forming apparatuses using a process cartridge including an image bearing member, but common to image forming apparatuses which do not use a process cartridge and in which the image forming process is applied to an image bearing member to thereby execute image formation and the image bearing member is repetitively used for image formation.

SUMMARY OF THE INVENTION

The objects of the present invention relate to the following matters:

a) Before an image bearing member or a process cartridge including at least an image bearing member reaches the end of its life, making the advance notice thereof possible;

b) To accurately foresee the film thickness of the image bearing member without resorting to the size of an outputted transfer material or the rate of intermittent and continuous outputs;

c) To make a user know the epitome of whether the the end of life of the image bearing member (process cartridge) is nearly over or has been reached;

d) To prevent the leakage of waste toner and further the contamination of an image which may arise when the user continues to use the image bearing member (process cartridge) although it has reached the end of its life;

e) To make the user know the number of remaining sheets in use when the life of the image bearing member (process cartridge) is nearly over;

f) To prevent fax reception or reception from a computer from becoming impossible even if there are some bad images when in a digital copying apparatus, the life of the image bearing member (process cartridge) is nearly over;

g) To enable the user to conjecture the manner of decrease in the number of used sheets or the interchange timing by always displaying the number of usable sheets for the image bearing member (process cartridge);

h) To enhance the detection accuracy of the foreseeing of the film thickness of the image bearing member; and i) If the life of the image bearing member (process cartridge) is nearly over or has been reached when computer output data are to be printed, to enable the user of the computer to know how to cope with it early.

FIG. is an illustration showing a method of detecting an electric current flowing to an image bearing member (a photosensitive drum).

Figure 3:
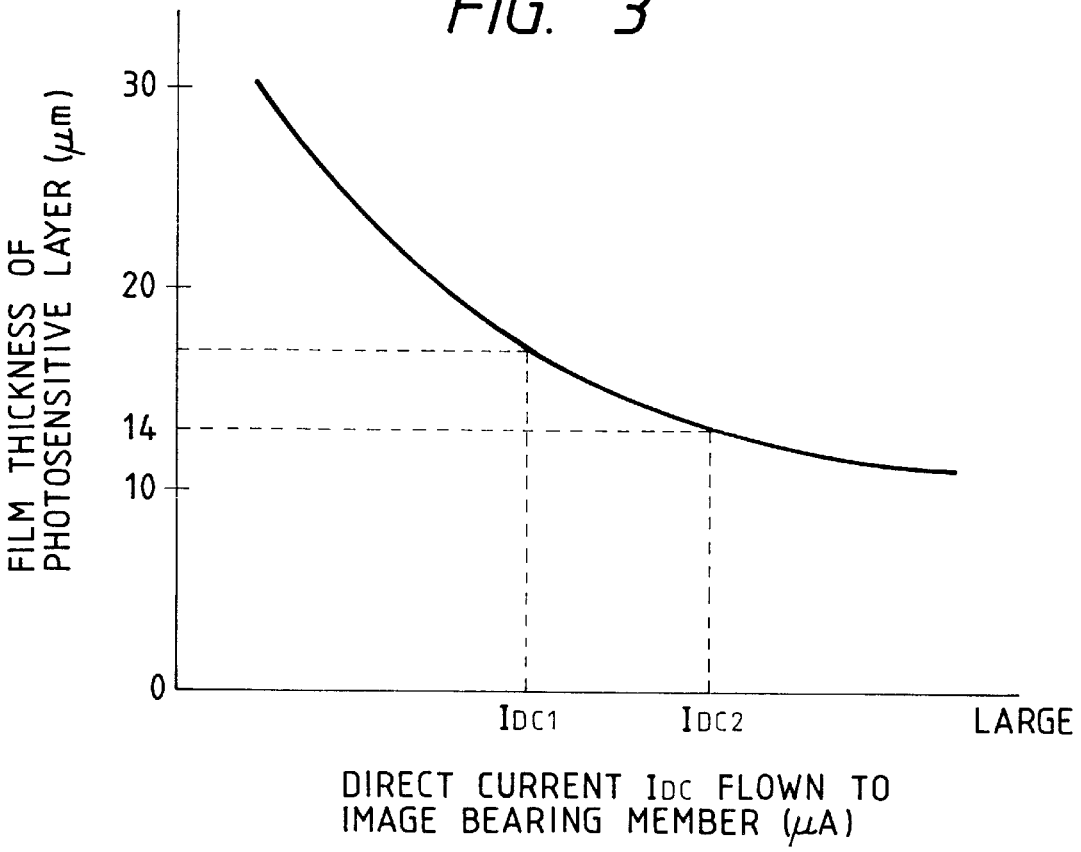

FIG. 3 is a graph showing the relation between a direct current flowing to the image bearing member and the film thickness of a photosensitive layer.

Figure 4:
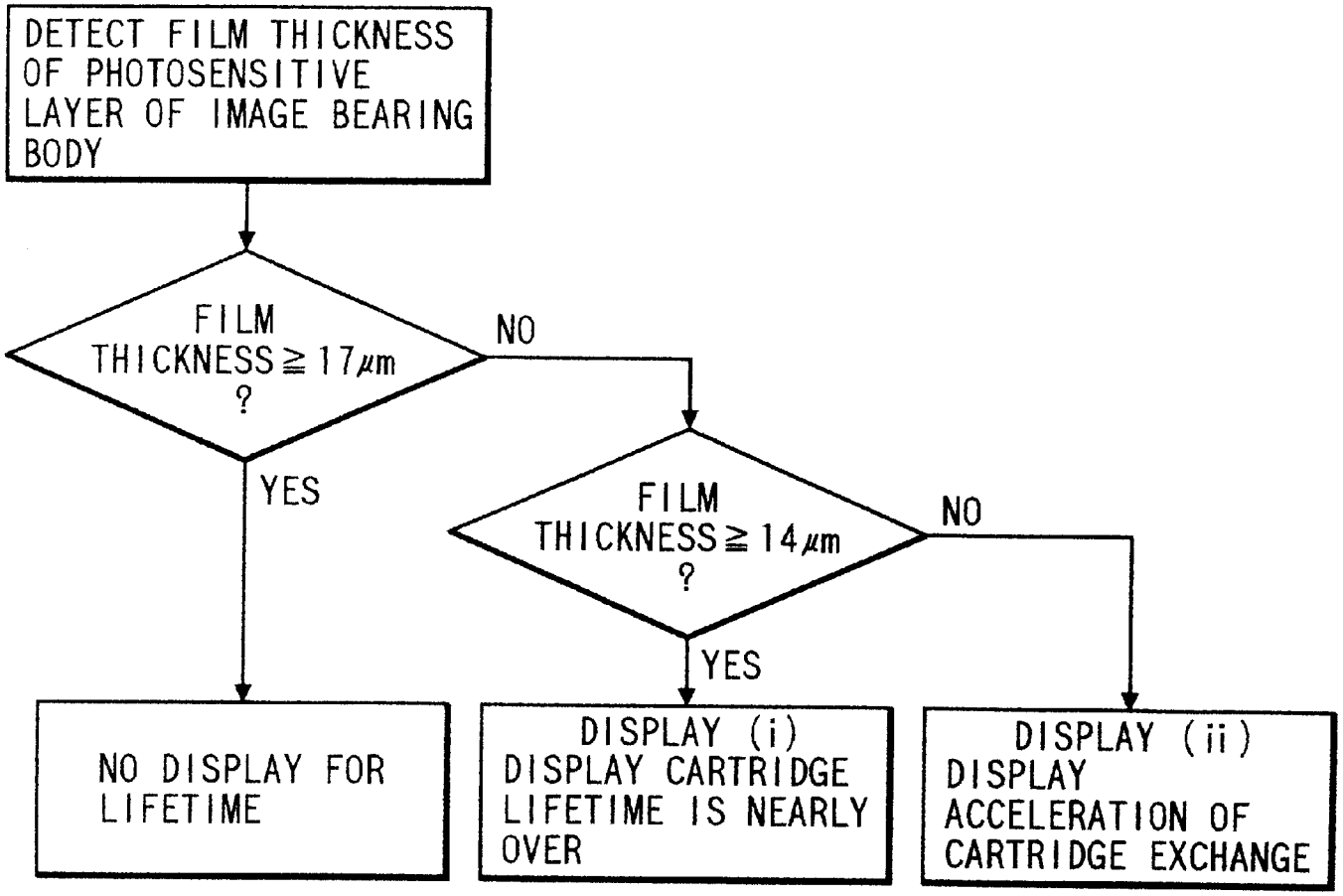

FIG. 4 is a flowchart regarding the life of a cartridge.

Figure 5:
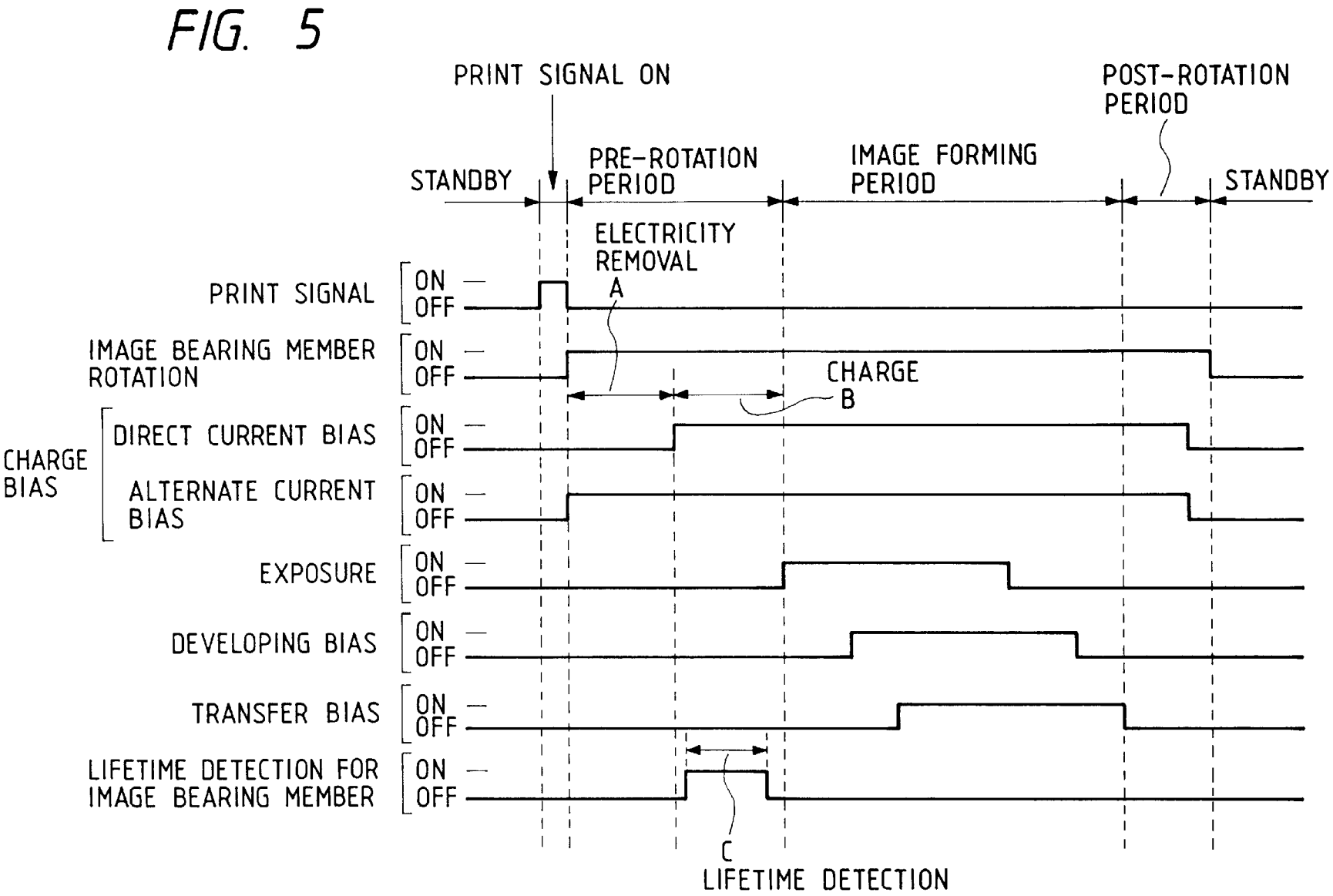

FIG. 5 is a time chart showing the sequence for detecting the electric current flowing to the image bearing member.

Figure 6:
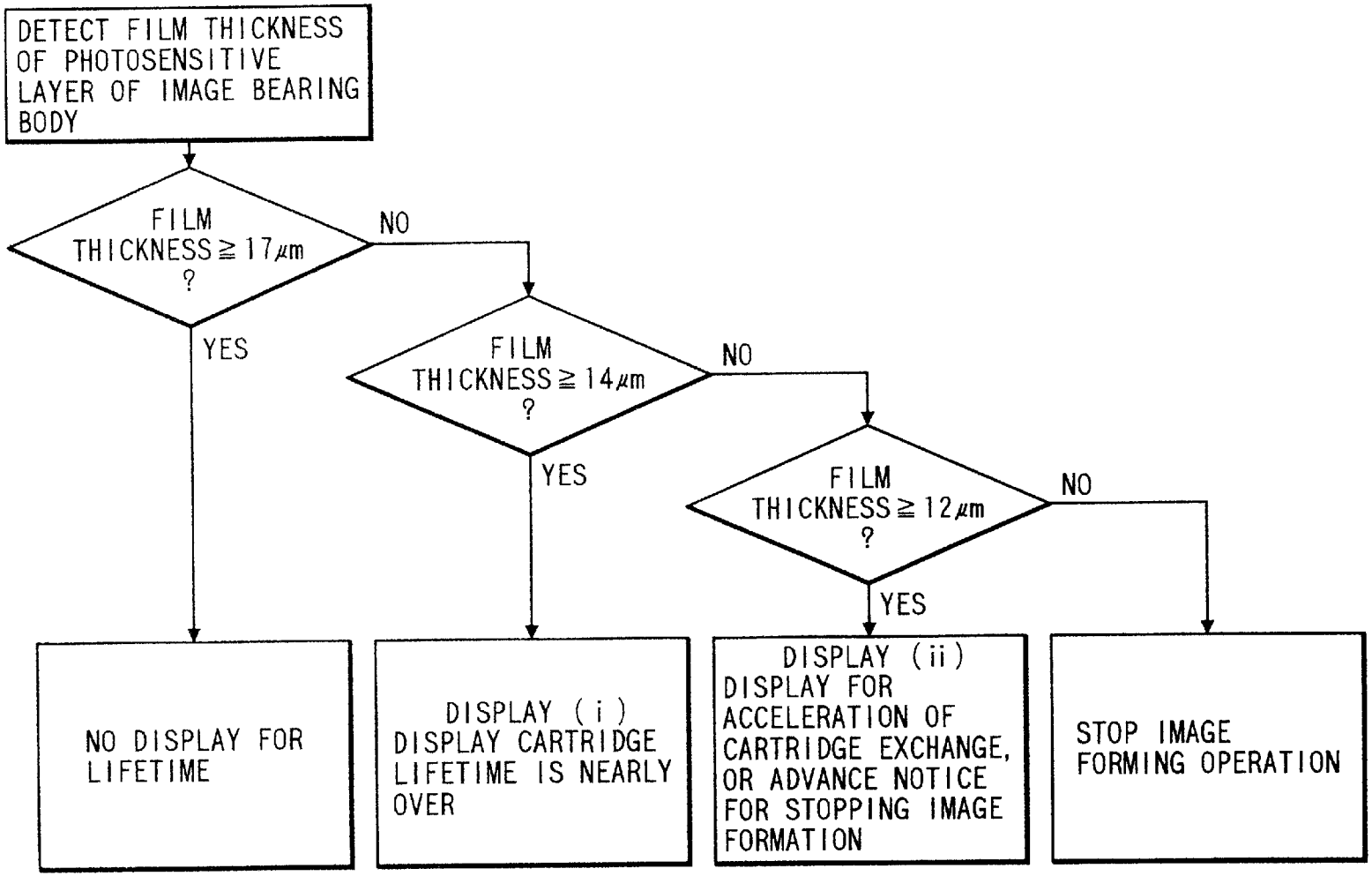

FIG. 6 is a flowchart regarding the life of a cartridge in Embodiment 2.

Figure 7:
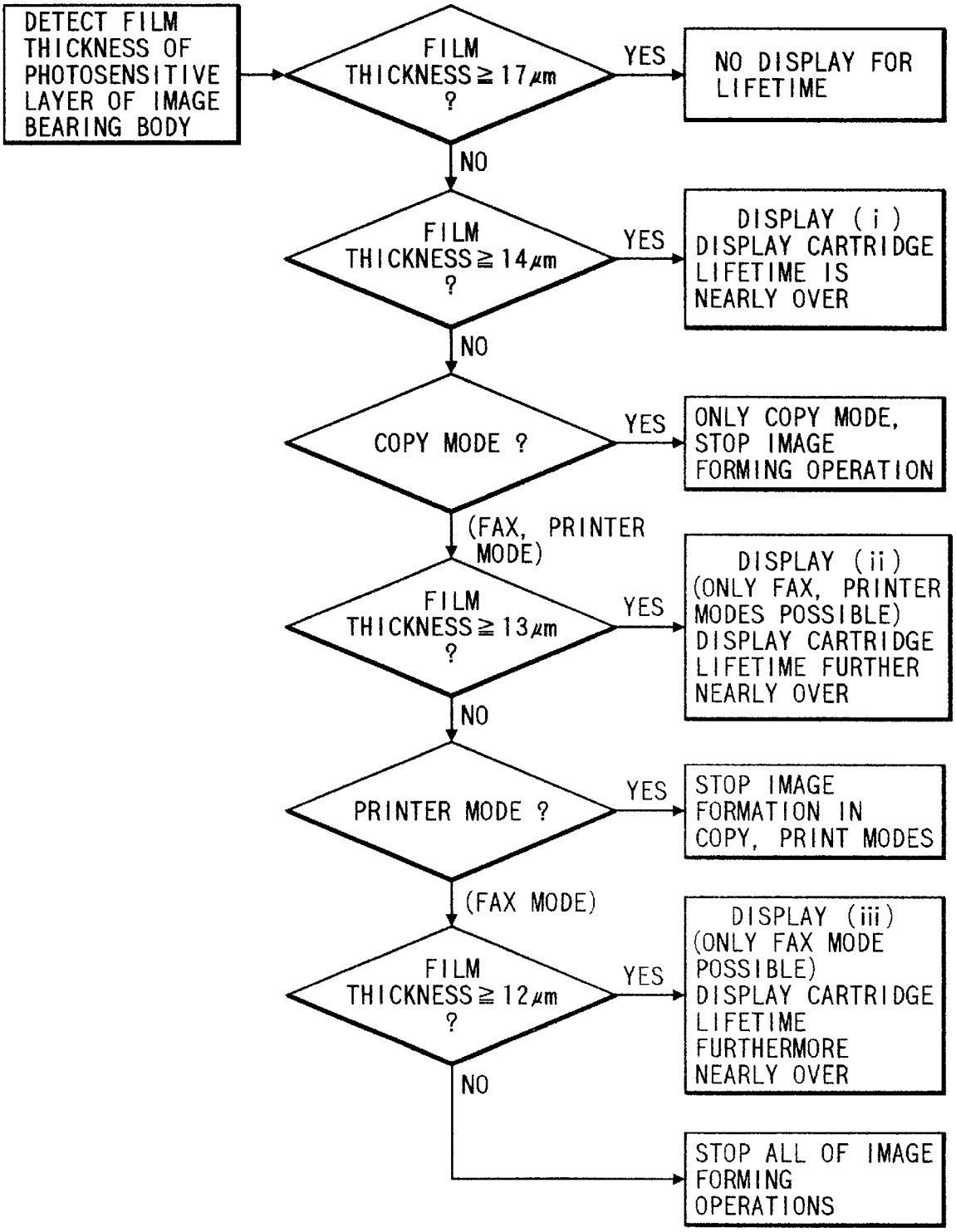

FIG. 7 is a flowchart regarding the life of a cartridge in Embodiment 3.

DESCRIPTION OF THE PREFERRED EMBODIMENTS

First Embodiment (FIGS. 1 to 5)

(1) Image Forming Apparatus

Figure 1:
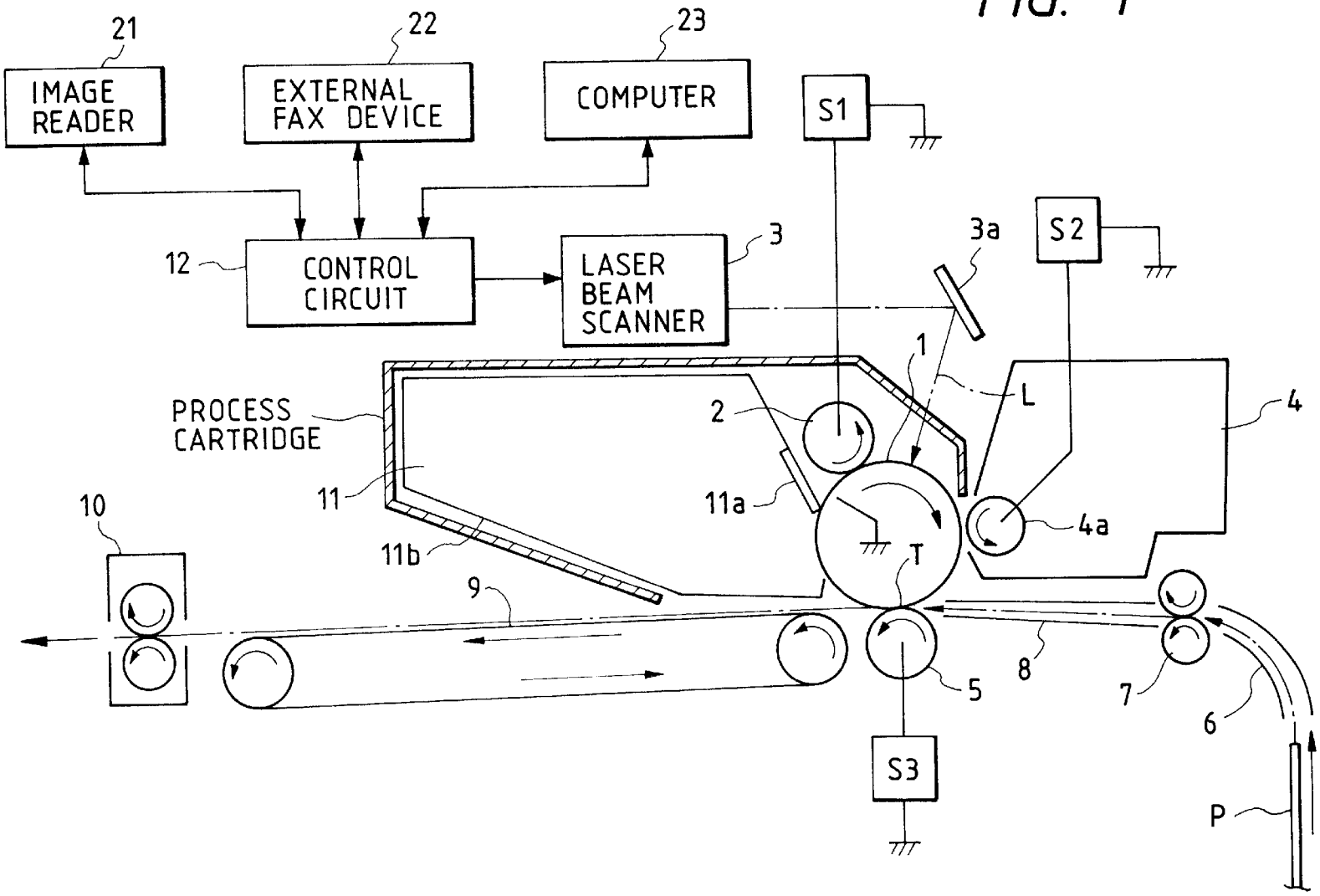
FIG. 1 is a model view schematically showing the construction of an image forming apparatus according to Embodiment 1.

FIG. 1 is a model view schematically showing the construction of an embodiment of an image forming apparatus according to the present invention, and this is a laser beam printer having a digital compound function utilizing the transfer type electrophotographic process of a process cartridge mounting and dismounting type.

The reference numeral 1 designates an electrophotographic photosensitive member (image bearing member) of a rotatable drum type comprising an electrically conductive drum base body of aluminum or the like, and a photosensitive layer (a photoconductive member) formed on the outer peripheral surface thereof. The image bearing member is rotatively driven at a predetermined peripheral speed (process speed) in a clockwise direction indicated by an arrow.

The reference numeral 2 denotes a charging roller (charging means) for uniformly charging the surface of the image bearing member 1 to a predetermined polarity and predetermined potential. This charging roller 2 is an electrically conductive rotatable member provided with an electrically conductive layer and a resistance layer around a mandrel, and is made substantially parallel with the image bearing member 1 and brought into contact with the surface of the image bearing member with a predetermined pressure force, and is rotated with the rotation of the image bearing member 1. A predetermined charging bias is applied from a charging bias voltage source Si to the charging roller 2 as this contact charging member, whereby the peripheral surface of the rotating image bearing member 1 is uniformly charged to a predetermined polarity and predetermined potential by a contact charging system.

In the present embodiment, use is made of the contact charging method of the so-called AC application type shown in Japanese Laid-Open Patent Application No. 63-149669. That is, a vibration voltage comprising a predetermined DC bias voltage and an AC bias voltage (an alternating voltage having a peak-to-peak voltage double the charging start voltage value of a charged member when a DC bias is applied to the contact charging member or greater) superposed thereon is applied from the charging bias voltage source S1 to the charging roller 2, and the image bearing member is substantially uniformly charged to the value of the applied DC bias. The contact charging means, as compared with non-contact charging means of the wire type such as a corona charger, has merits such as a low voltage and low power, creation of a small amount of ozone created and compactness.

The reference numeral 3 designates a laser beam scanner (image exposure means) which outputs a laser beam intensity-modulated correspondingly to the timeserial electrical digital pixel signal of desired image information, and scan-exposes L the surface of the rotating image bearing member uniformly charged by the charging roller 2. By this scan-exposure L, the potential of the exposed light portion of the surface of the rotating image bearing member is attenuated and an electrostatic latent image corresponding to the desired image information is formed on the surface of the rotating image bearing member. The reference character 3*a* denotes a reflecting mirror for deflecting the output laser beam from the laser beam scanner 3 to the exposure position of the image bearing member 1.

The reference numeral 4 designates a developing device for visualizing the electrostatic latent image formed on the surface of the image bearing member 1 into a toner image. The reference character 4*a* denotes a developing roller (a developing sleeve) rotatively driven in a counter-clockwise direction indicated by an arrow, and the reference character S2 designates a voltage source for applying a predetermined developing bias to the developing roller 4*a*. The present embodiment is a reverse developing device which causes a toner charged to the same polarity as the charges of the image bearing member to adhere to the exposed light portion of the surface of the image bearing member 1 and develop the electrostatic latent image.

The reference numeral 5 denotes a transfer roller (transfer means) which is brought into contact with the surface of the image bearing member 1 with a predetermined pressure force, and is rotated forwardly in the direction of rotation of the image bearing member 1 substantially at the same peripheral speed as that of the image bearing member. The portion of contact T between the image bearing member 1 and the transfer roller 5 is a transfer nip portion.

The letter P designates a transfer sheet (a recording medium) which is supplied from a sheet supply portion (not shown), and passes along a sheet path comprised of a guide 6 to a pair of register rollers 7, and the leading end of which is once received by the nip portion between the pair of register rollers 7 which are being stopped from rotating. Then, the pair of register rollers 7 are rotatively driven at predetermined control timing, whereby the transfer sheet P is held between and conveyed by the pair of register rollers 7 and is fed to the transfer nip portion T through a sheet path comprised of a guide 8.

The start of the rotation of the pair of register rollers 7 is controlled so that when the leading end portion of the toner image portion on the surface of the rotating image bearing member has arrived at the transfer nip portion T, the leading end portion of the transfer sheet P may also just arrive at the transfer nip portion T. From the point of time at which the leading end portion of the transfer sheet P has arrived at the transfer nip portion T, the application of a predetermined transfer bias is started from a transfer bias voltage source S3 to the transfer roller 5. The transfer bias is a DC bias opposite in polarity to the charge of the toner. The transfer sheet P fed to the transfer nip portion T is subjected to the transfer of the toner image on the surface of the rotating image bearing member with the electrostatic attraction by the transfer bias and the pressure force in the process of being held and conveyed by the transfer nip portion T. The application of the transfer bias to the transfer roller 5 is stopped at a point of time whereat the trailing end portion of the transfer sheet P has passed the transfer nip portion T.

The transfer sheet P which has passed the transfer nip portion T and has been subjected to the transfer of the toner image is separated from the surface of the rotating image bearing member 1, and is introduced into a fixating device 10 by a conveying device 9, and the transferred toner image thereon is fixated as a permanently secured image on the surface of the transfer sheet P by heat and pressure. The transfer sheet P subjected to the fixating process for the toner image is outputted as an image forming article. In the case of a both-surface image formation mode or a multiplex image formation mode, the transfer material having an image formed on one surface thereof or having a first image formed thereon which has left the fixating device enters a recirculation sheet path mechanism (not shown) and is reversed or not reversed and is again fed to the transfer nip portion T.

The rotating image bearing member 1 after the separation of the transfer sheet therefrom has surface residual contaminants such as untransferred toner (residual toner) and sheet powder scraped off by the cleaning blade 11*a* of a cleaning device 11 and is thus cleaned, and is repetitively used for image formation. The residual toner scraped off from the surface of the image bearing member is collected into a waste toner container 11*b*.

(2) Process Cartridge

PC designates a process cartridge removably mountable with respect to the apparatus body (printer body), and the three process instruments, i.e., the image bearing member 1, the charging roller 2 and the cleaning device 11, are integrally contained in the cartridge housing so that these process instruments are made collectively removably mountable with respectively the apparatus body. The process cartridge PC is mounted with respect to the apparatus body in a predetermined manner, whereby it is mechanically and electrically connected to the apparatus body, and the image forming apparatus becomes capable of performing the image forming operation.

The process cartridge PC may also include the developing device 4 as shown in Japanese Laid-Open Patent Application No. 4-1787. The process cartridge can be provided with the image bearing member and at least one of the process instruments, i.e., the charging roller 2, the cleaning device 11 and the developing device 4.

(3) Digital Compound Function

The image forming apparatus of the present embodiment is a digital compound machine having the copying function (copy mode), the fax function (fax mode) and the printer function (printer mode) and capable of selecting each mode.

a) Copying Function

The image forming apparatus has an image reader (image scanner) for photoelectrically reading the image of an original, and digitally processes the photoelectrically read image signal thereof and executes image formation. In FIG. 1, the reference numeral 21 designates the image reader, and the image signal of the image of the original set and photoelectrically read by the image reader is sent to a laser beam scanner 3 through the control circuit 12 of the apparatus body. A laser beam intensity-modulated correspondingly to the time-serial electrical digital pixel signal of the original image information is outputted from the laser beam scanner in the apparatus body and image formation is executed, whereby a copy of the image of the original is outputted.

b) Fax Function

This is the function of effecting mutual communications with an external fax device (an image information transmitting and receiving device or a facsimile device). In FIG. 1, the reference numeral 22 denotes an external fax device which is telephone-circuit-connected to the control circuit 12 of the apparatus body, and the received image information from the external fax device 22 is sent to the laser beam scanner 3 through the control circuit 12 of the apparatus body. In the apparatus body, a laser beam intensity-modulated correspondingly to the time-serial electrical digital pixel signal of the received image information is outputted from the laser beam scanner and image formation is executed, and a record of the received image information is outputted. The transmission of the image information to the external fax device 22 is done by the image of the original to be transmitted being photoelectrically read by the image reader 21, and the image signal thereof being transmitted to the external fax device 22 through the control circuit 12. The external fax device 22 performs the image forming operation of outputting the record of the transmitted image information.

c) Printer Function

This is the function of printing the output image information from a computer. In FIG. 1, the reference numeral 23 designates a computer as an external apparatus, and it is circuit-connected to the control circuit 12 of the apparatus body, and the output image information of the computer 23 is sent to the laser beam scanner 3 through the control circuit 12 of the apparatus body. In the apparatus body, a laser beam intensity-modulated correspondingly to the time-serial electrical digital pixel signal of the computer output image information is outputted from the laser beam scanner and image formation is executed, and the print of the computer output image information is outputted.

The above-described copying function, fax function and printer function are mutually changed over automatically.

(4) Life Detection of the Process Cartridge PC,

Display Alarm, Apparatus Control, etc.

A) Life Detecting Means for the Process Cartridge PC

In the present embodiment, by foreseeing the film thickness of the photosensitive layer as the image forming function layer of the photosensitive drum 1 as the image bearing member contained in the process cartridge PC, the life detection of the process cartridge is effected. That is, as previously described, the image forming operation is repeated and the image bearing member is repetitively used for image formation, so that the photosensitive layer as the image forming function layer of the image bearing member is gradually scraped by the frictional contact thereof with the cleaning blade hla and the AC voltage of the charging roller 2 and the image forming capability thereof is gradually reduced. The life of the image bearing member 1, i.e., the process cartridge, is prescribed by the remaining film thickness of the photosensitive layer as the image forming function layer of the image bearing member.

In the present embodiment, it is designed such that the electric current flowing from the charging roller 2 to the image bearing member 1 when a predetermined voltage is applied to the charging roller 2 as a contact charging member is detected, then the life of the image bearing member, i.e., the life of the process cartridge, is detected. That is, when the predetermined voltage is applied to the charging roller 2, the photosensitive layer of the image bearing member 1 is scraped and the thickness thereof is decreased, the electrostatic capacity of the photosensitive layer is increased and the electric current flowing to the image bearing member 1 changes. By detecting this change, the life of the image bearing member is detected.

Figure 2:
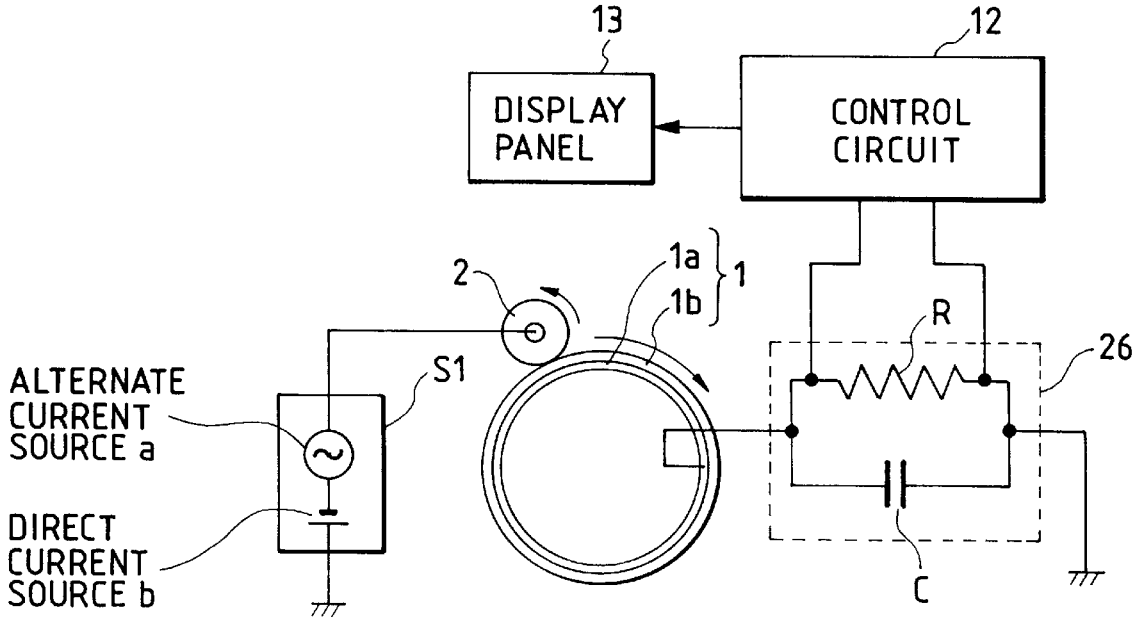

In the present embodiment, as shown in FIG. 2, between the electrically conductive drum base body 1*a* of the image bearing member 1 and the earth, there is provided a detection circuit (life detecting means for detecting the life of the image bearing member 1) 26 comprising a resistor R for measuring the direct current flowing to the image bearing member 1 from the charging roller 2 which is brought into contact with the image bearing member 1 and to which a superposed voltage comprising a DC bias and an AC bias superposed one upon the other has been applied as a charging bias, and a capacitor C for bypassing the alternating current. It is designed such that the voltage across the resistor R is measured by a control circuit 12, the current film thickness of the photosensitive layer lb of the image bearing member 1 is detected by the control circuit 12 on the basis of the measured value, and the life of the image bearing member 1 is judged by the control circuit 12. A method of foreseeing the film thickness of the photosensitive layer of the image bearing member when a corona charger is used as the charging means is disclosed in Japanese Laid-Open Patent Application No. 4-57068, etc.

FIG. 3 is a graph showing a change in the direct current flowing to the image bearing member 1 when the film thickness of the photosensitive layer lb changes with the voltage applied to the charging roller 2 being constant. As can be seen from FIG. 3, the direct current flowing to the image bearing member 1 increases as the film thickness of the photosensitive layer 1*b* decreases. Generally, when the thickness of the photosensitive layer 1*b* becomes equal to or less than 14 $\mu$m, the image formed thereon suffers from much fog or many injuries, and therefore when the direct current flowing to the image bearing member 1 exceeds $I_{DC2}$, it can be Judged that the life of the image bearing member 1, i.e., the life of the process cartridge PC, is exhausted. However, the relation between the photosensitive layer 1*b* and the direct current value as shown in FIG. 3 differs depending on the material of the photosensitive layer 1*b*, the process speed of the image forming apparatus, etc.

The present embodiment has been described with respect to a case where the detection circuit 26 as the life detecting means is provided between the image bearing member 1 and the earth, whereas this is not restrictive, but the detection circuit 26 may be provided between the charging roller 2 and the charging bias voltage source S1, or between the charging bias voltage source Sl and the earth.

B) Life Display Alarm for the Process Cartridge PC

The control circuit 12 causes display means, e.g. a display panel 13 of the liquid crystal type disposed at a suitable location on the operating board of the image forming apparatus to display information about the life of the process cartridge PC in conformity with the result of the detection of the direct current.

In the present embodiment, as shown in FIG. 4, if the film thickness of the photosensitive layer as it has been converted from the result of the measured direct current is 17 $\mu$m or greater, the display regarding the life of the process cartridge is not effected. If the film thickness is between 14 $\mu$m to 17 $\mu$m, it is displayed that the life of the process cartridge is nearly over. Further, when the photosensitive layer 1*b* is scraped and becomes thinner than 14 $\mu$m, the output image usually becomes an image suffering from much fog and many injuries and therefore, display for the acceleration of the interchange of the process cartridge PC is done.

By the life display alarm for the process cartridge PC as described above, when a bad image such as fog or injuries occurs, the user can be informed of a method of coping with it.

Also, if the image forming operation is continued with a more or less bad image allowed, the waste toner container 11*b* of the cleaning device 11 in the process cartridge will become full of waste toner and become incapable of containing any more waste toner therein. This leads to the possibility of the problem that the toner overflows from the cleaning device 11 arising, the display for the acceleration of the interchange is effective to avoid such problem. Further, in the present embodiment, it is designed to display that the life is nearly over before the life of the process cartridge is exhausted, and therefore it becomes possible to prepare a new process cartridge in advance.

C) Life Detection Sequence

In the present embodiment, as shown in the sequence chart of FIG. 5, the detection of the life of the image bearing member 1, i.e., the process cartridge PC (the detection of the electric current flowing from the charging roller 2 to the image bearing member) is effected during the pre-rotation period of the image forming apparatus after the inputting of the print signal.

That is, when the print signal enters the control circuit 12 of the image forming apparatus, the rotative driving of the image bearing member 1 is started and the image forming apparatus enters the pre-rotation period before image formation. Simultaneously therewith, only an AC bias is applied from the charging bias voltage source S1 to the charging roller 2. In this state, since the DC potential is OV, the charges remaining on the image bearing member 1 are all removed. This charge removing step A is effected during at least one full rotation of the image bearing member 1.

Thereafter, a DC bias is also applied to the charging roller 2. This AC bias+ DC bias applying step B, like the above-described charge removing step A, is effected during at least one full rotation of the image bearing member 1. At this step B, the surface of the image bearing member 1 is contact-charged to the potential substantially corresponding to the applied DC bias. During this step B, the direct current flowing to the image bearing member 1 is measured by the aforedescribed detection circuit 26 (FIG. 2), and the step C of detecting the life of the image bearing member 1, i.e., the process cartridge PC is executed. During the above-described pre-rotation period, the developing bias and the transfer bias had better be stopped. This is because when the developing bias and the transfer bias are in their ON state, electric currents flow from the developing bias and the transfer bias to the image bearing member 1. Thus, it becomes impossible for the life of the image bearing member 1 to be accurately detected.

When the life detecting step C is terminated, exposure based on the image formation is started and the image forming apparatus enters an image forming period.

Exposure based on the image information is effected, whereby an electrostatic latent image is formed on the image bearing member 1, and when the leading end portion of the formed electrostatic latent image is moved to the developing portion, a developing bias is applied and the electrostatic latent image is toner-developed. When the leading end portion of the toner image is moved to the transfer portion T, a transfer bias is applied and the toner image on the image bearing member 1 is transferred to a transfer material P fed to the transfer portion T in timed relationship with the latter.

The developing bias is stopped when the trailing end portion of the electrostatic latent image on the image bearing member 1 passes the developing portion, and the transfer bias is stopped when the trailing end portion of the transfer sheet P passes the transfer portion T, and the image forming apparatus enters a post-rotation period. During the post-rotation period, the transfer sheet P on which the toner image has been formed is discharged out of the apparatus, and the DC charging bias and the AC charging bias are both stopped. Then the rotative driving of the image bearing member 1 is stopped and the image forming apparatus is held in its standby state until the next print signal is inputted.

In the case of continuous copying, the image forming period is repetitively executed for a required number of sheets, and after the last image forming period is terminated, the image forming apparatus enters the post-rotation period. Thus, on the basis of the life detection of the image bearing member during the aforedescribed pre-rotation period, display regarding the life of the image bearing member, i.e., the process cartridge, is done on the display panel by the control circuit 12 at the display sequence of FIG. 4 previously described.

Second Embodiment (FIG. 6)

In the above-described first embodiment, when it is judged that the film thickness of the photosensitive layer 1*b* of the image bearing member 1 is equal to or less than 14 μm, the display for accelerating the interchange of the process cartridge PC is done. Even in that case, however, if a more or less bad image is allowed and the user continues the image forming operation, as previously described, the waste toner container 11*b* in the process cartridge PC becomes full of waste toner. Thus, it becomes incapable of containing any more waste toner, so there may arise the problem that the toner overflows from the cleaning device 11. Thus, at this time, the interior of the apparatus and further a portion of the output sheet are contaminated by the overflowing toner.

Accordingly, in the present embodiment, as shown in FIG. 6, when the image forming operation is further continued and the film thickness of the photosensitive layer 1*b* of the image bearing member 1 becomes equal to or less than 12 μm, the image forming operation is forcibly prohibited, so that the above-noted problem of the contamination of the interior of the apparatus and the transfer sheet can be avoided. Also, since sudden stoppage is inconvenient it is designed that as long as the film thickness of the photosensitive layer is in the range of 12 to 14 μm, there is displayed advance notice to the effect that the prohibition of the image forming operation will soon be done, thus the above-noted problem can be avoided.

Third Embodiment

In the above-described second embodiment, it is designed that when the film thickness of the photosensitive layer 1*b* of the image bearing member 1 becomes small, the advance notice of the prohibition of the image forming operation is displayed, but if the rough number of usable sheets is displayed, it will be more effective. As the timing of display, the display is done when for example, it is detected that the film thickness of the photosensitive layer is 14 μm or less, or display may be done a plurality of times such as twice, i.e., at points of time whereat the film thickness has become equal to or less than 17 μm and whereat the film thickness has become equal to or less than 14 μm. Alternatively, the rough number of sheets used may always be displayed on a portion of an operating portion or the like. Also, as the displayed substance, some information proportional to the number of sheets may be displayed, for example, blue display may be done if the number of usable sheets is 10,000 or greater, yellow display may be done if the number of usable sheets is 5,000 to 10,000, and red display may be done if the number of usable sheets becomes less than 5,000.

Fourth Embodiment (FIG. 7)

In recent years, so-called digital compound machines having, besides the copying function of digitally processing an image signal to form an image on the basis of a signal from a reader or a scanner, at least two different functions such as the fax function for effecting mutual communications with an external fax and the printer function for printing an output from a computer have come to be widely used. The aforedescribed image forming apparatus of FIG. 1 is such a digital compound machine.

When in such a digital compound machine, an attempt is made to stop the image forming operation after a predetermined number of sheets or immediately in conformity with the output of the life detecting means 26 for the photosensitive layer 1*b* of the image bearing member 1, it is preferable to make the number of usable sheets till the stoppage differ depending on the use modes of the image forming operation, i.e., the copy mode, the fax mode, the printer mode, etc. Particularly in the case of the copy mode, it is preferable to stop the image forming operation earliest.

Describing this situation with the sequence chart of FIG. 7 as reference, when the film thickness of the photosensitive layer 1*b* of the image bearing member 1 becomes equal to or less than 17 μm, it is displayed that the life of the process cartridge is nearly over.

When the film thickness then becomes equal to or less than 14 μm, the image forming operation is stopped only in the copy mode. The reason why of the above-described three kinds of modes, the copy mode is stopped earliest (the fax mode and the printer mode are stopped late) is that during the use in the copy mode, the user is near the apparatus which enables to interchange the process cartridge at once. In the printer mode and the fax mode, the user may not be near the apparatus. At this time, image formation in the printer mode and the fax mode are possible, but the life of the cartridge is more nearly over and that the copy mode has been stopped are displayed.

When the film thickness becomes equal to or less than 13 μm, the image forming operation in the printer mode, in addition to that in the copy mode, is also stopped. The reason why the image forming operation in the fax mode is stopped lastly is that the user on the transmitting side is far which makes difficult to interchange the cartridge. In the fax mode, it is important to transmit information and the presence of an image fault such as some injuries or fog is often allowed. At this time, it is displayed that the final life of the cartridge is more nearly over and that the image forming operations in the copy mode and the printer mode have been stopped.

When the film thickness becomes equal to or less than 12 μm, the image forming operations in all modes including the fax mode are stopped.

Fifth Embodiment

When the digital compound machine as described in the fourth embodiment is used in the printer mode, it is effective to send information based on the result of the foreseeing of the film thickness of the photosensitive layer of the image bearing member to the computer side which sends image information for printing. That is, when during the use of the apparatus in the printer mode, the film thickness of the photosensitive layer 1*b* of the image bearing member 1 becomes small, it becomes possible to display that the life of the process cartridge PC is nearly over, and to accelerate the interchange of the process cartridge and to give the advance notice of the stoppage of the image forming operation.

Also, when the image forming operation has been actually stopped, the display of a print error is usually done on the computer side. At this time, the life of the process cartridge has been exhausted and that the interchange of the process cartridge is necessary are displayed, it will become possible to cope with it smoothly.

Other Embodiments

1) When in each of the above-described embodiments, for detecting the electric current flowing to the image bearing member 1, it is desirable to stop the developing bias and the transfer bias by which an electric current flows into the image bearing member 1 for increasing the detection accuracy.

2) Also, the detection of the electric current may be effected for each predetermined number of sheets or may be effected at the end of a series of image forming operations during continuous copying.

3) The information based on the result of the detection of the electric current may be present or absent while there are a sufficient number of sheets on which images can be formed. However, when the life of the process cartridge is nearly over, it is preferable to display such information at all times or to effect it every time after the termination of a series of image forming operations (in the case of one-sheet mode copy, thereafter, and in the case of continuous copying, after the termination of a predetermined number of copies).

4) Also, while in the above-described embodiments, the timing for the changeover of the substance to be displayed or the stoppage of the image forming operation has been described as the film thicknesses of 17, 14, 13 and 12 μm, but this is not restrictive and the timing can be suitably set.

5) The detecting means for foreseeing the film thickness of the photosensitive layer 1b of the image bearing-member 1 is not restricted to that described in the embodiments. For example, instead of detecting the electric current flowing through the image bearing member when a predetermined voltage is applied to the contact charging member, the voltage applied to the contact charging member when a predetermined electric current is supplied to the contact charging member may be detected.

6) Also, as an element for the detection of the life of the process cartridge, the information of the quantity of waste toner in the cartridge may be combined. As a method of detecting the quantity of waste toner, there may be adopted a well-known method utilizing a change in the vibration of a piezoelectric element as shown in Japanese Laid-Open Patent Application No. 6-266270, but this is not restrictive.

7) Also, while the embodiments have been described with respect to an image forming apparatus having a process cartridge including an image bearing member, the present invention can also be applied to an image forming apparatus in which the image bearing member can be singly interchanged instead of the process cartridge.

8) The contact charging member is not restricted to a charging roller, but may be in other form such as a charging blade, a fur brush or a magnetic brush.

9) As the waveform of the AC bias in the charging bias or the developing bias to the contact charging member or the developing member, a sine wave, a rectangular wave, a triangular wave or the like can be suitably used. Also, the AC bias includes a voltage of rectangular wave formed, for example, by periodically switching on and off a DC power source. Thus, as the AC bias, a bias of which the voltage value changes periodically can be used.

10) The charging bias to the contact charging member can be only a DC bias.

11) The charging means for the image bearing member may also be of the noncontact such as a corona charger.

12) In the present invention, the image forming apparatus also includes such an image forming display device that an image portion formed on the surface of a member of the movable round type or the like to be charged is located in a display portion for use in reading and the member to be charged is repetitively used for the formation of a displayed image.

13) The image exposure means as information writing means to the surface of the image bearing member in the image forming apparatus is not restricted to the laser scanning exposure means in the embodiments for forming a digital latent image, but may be ordinary analog image exposure means or other light emitting element such as an LED. Also, the exposure means may be any means capable of forming an electrostatic latent image corresponding to image information, such as means using a combination of a light emitting element such as a fluorescent lamp and a liquid crystal shutter or the like.

When an electrostatic recording dielectric member is used as the image bearing member, the uniformly charged surface of the dielectric member has its charges selectively removed by charge removing means such as a charge removing needle head or an electronic gun, so that an electrostatic latent image corresponding to desired image information is written in and formed.

14) The developing device may adopt various developing principles and systems. Of course, it may be a regular developing system.

15) In an image forming apparatus of the transfer type, the transfer system is not limited to the roller transfer shown in the embodiments, but may use blade transfer or other contact transfer charging system, or a corona discharger.

16) The image forming apparatus of the present invention may be an image forming apparatus for not only forming a monochromatic image by the use of an intermediate transfer member such as a transfer drum or a transfer belt, but also forming a polychromatic or full-color image by multiplex transfer or the like.

17). The image forming apparatus of the present invention may be an image forming apparatus of the cleanerless system.

What is claimed is:

1. An image forming apparatus comprising: an image bearing member;

detecting means for detecting a parameter associated with a thickness of a layer of said image bearing member; and display means for displaying an information about a life of said image bearing member when the parameter detected by said detecting means reaches a predetermined value;

wherein said apparatus has at least two of a facsimile mode, a printer mode and a copy mode, and the predetermined value is variable in conformity with the mode selected among the modes of said apparatus.

2. An image forming apparatus according to claim 1, wherein said information displayed by said display means is at least one of informations indicating the life of said image bearing member being nearly over, an information accelerating preparation of a new image bearing member, an information accelerating interchange of the image bearing member with a new one, an information giving an advances notice of prohibition of the image forming operation, and information indicating the result of prohibition of the image forming operation.

3. An image forming apparatus according to claim 1, wherein when the copy mode is selected, the image forming operation is prohibited earlier than in a case when the facsimile mode is selected.

4. An image forming apparatus according to claim 1, wherein when said copy mode is selected, the image forming operation is prohibited earliest among the modes.

5. An image forming apparatus according to claim 1, further comprising having a charging member capable of contacting with said image bearing member for charging it, and wherein the parameter is an electric current flowing through said charging member when a predetermined voltage is applied thereto.

6. An image forming apparatus according to claim 5, wherein said display means is capable of displaying at least two different kinds of informations corresponding to at least two different electric currents detected by said detecting means.

7. An image forming apparatus according to claim 6, wherein said information displayed by said display means is at least two of informations indicating the life of said image bearing member being nearly over, an information accelerating the preparation of a new image bearing member, an information accelerating interchange of the image bearing member with a new one, an information giving an advance notice of prohibition of the image forming operation, and information indicating the result of prohibition of the image forming operation.

8. An image forming apparatus according to claim 5, wherein the image forming operation is prohibited after a predetermined number of image formations have been effected, after a predetermined electric current has been detected by said detecting means.

9. An image forming apparatus according to claim 8, wherein when the predetermined electric current is detected by said detecting means, the information corresponding to the predetermined number is displayed by said display means.

10. An image forming apparatus according to claim 9, wherein every times image formation is effected from after the predetermined electric current is detected by said detecting means until the image forming operation is prohibited, the information corresponding to the number of remaining cycles of the image formation until the image forming operation is prohibited is displayed by said display means.

11. An image forming apparatus according to claim 5, wherein said image bearing member is provided with a photosensitive layer, and the electric current increases as the thickness of said photosensitive layer decreases.

12. An image forming apparatus according to claim 1, further comprising a process cartridge removably mountable onto said apparatus, said process cartridge including said image bearing member and process means acting thereon and being interchangeable with a new process cartridge to interchange said image bearing member with a new image bearing member.

13. An image forming apparatus according to claim 12, wherein said process means is said charging member.

14. An image forming apparatus according to claim 1, wherein when the copy mode is selected, the information about the life of said image bearing member is displayed earlier than in a case when the facsimile mode is selected.

15. An image forming apparatus according to claim 1, wherein when the copy mode is selected, the information about the life of said image bearing member is displayed earlier than in a case when the printer mode is selected.

16. An image forming apparatus according to claim 1, wherein when the printer mode is selected, the information about the life of said image bearing member is displayed earlier than in a case when the facsimile mode is selected.

17. An image forming apparatus according to claim 1, wherein when the copy mode is selected, the information about the life of said image bearing member is displayed earliest among the modes.

* * * * *

UNITED STATES PATENT AND TRADEMARK OFFICE

CERTIFICATE OF CORRECTION

PATENT NO. : 5,907,739

DATED : May 25, 1999

INVENTOR(S) : TAKEO TSUNEMI

It is certified that error appears in the above-identified patent and that said Letters Patent is hereby corrected as shown below:

COVER PAGE AT ITEM [22],
Insert --This patent issued on a continued prosecution application filed under 37 CFR 1.53(d), and is subject to the twenty year patent term provisions of 35 U.S.C. 154(a)(2).--.

COLUMN 3,
Line 18, "the the" should read --the--.

COLUMN 4,
Line 50, "created" should be deleted; and
Line 54, "timeserial" should read --time-serial--.

COLUMN 7,
Line 28, "hla" should read --11a--.

COLUMN 8,
Line 3, "lb" should read --1b--;
Line 11, "Judged" should read --judged--; and
Line 23, "S1" should read --S1--.

UNITED STATES PATENT AND TRADEMARK OFFICE

CERTIFICATE OF CORRECTION

PATENT NO. : 5,907,739

DATED : May 25, 1999

INVENTOR(S) : TAKEO TSUNEMI

It is certified that error appears in the above-identified patent and that said Letters Patent is hereby corrected as shown below:

COLUMN 10,
Line 64, "differ" should read --different--.

COLUMN 12,
Line 38, "form" should read --forms--.

COLUMN 13,
Line 29, "comprising: an" should read --comprising: ¶ an--; and
Line 48, "advances" should read --advance--.

COLUMN 14,
Line 28, "times" should read --time--.

Signed and Sealed this

Fifteenth Day of August, 2000

*Attest:*

Q. TODD DICKINSON

*Attesting Officer*

*Director of Patents and Trademarks*